US010895145B2

(12) United States Patent
Brune et al.

(10) Patent No.: US 10,895,145 B2
(45) **Date of Patent: *Jan. 19, 2021**

(54) ADVANCED UNDERGROUND HOMING SYSTEM, APPARATUS AND METHOD

(71) Applicant: Merlin Technology Inc., Kent, WA (US)

(72) Inventors: Guenter W. Brune, Bellevue, WA (US); John E. Mercer, Gig Harbor, WA (US); Albert W. Chau, Woodinville, WA (US)

(73) Assignee: Merlin Technology Inc., Kent, WA (US)

( * ) Notice: Subject to any disclaimer, the term of this patent is extended or adjusted under 35 U.S.C. 154(b) by 27 days.

This patent is subject to a terminal disclaimer.

(21) Appl. No.: 16/161,043

(22) Filed: Oct. 15, 2018

(65) Prior Publication Data

US 2019/0048711 A1 Feb. 14, 2019

Related U.S. Application Data

(63) Continuation of application No. 15/231,764, filed on Aug. 8, 2016, now Pat. No. 10,107,090, which is a (Continued)

(51) Int. Cl.
*E21B 47/024* (2006.01)
*E21B 47/0232* (2012.01)
(Continued)

(52) U.S. Cl.
CPC ..... *E21B 47/024* (2013.01); *E21B 7/046* (2013.01); *E21B 44/005* (2013.01); *E21B 47/0232* (2020.05)

(58) Field of Classification Search
CPC ..... E21B 47/024; E21B 44/005; E21B 7/046; E21B 47/02224
See application file for complete search history.

(56) References Cited

U.S. PATENT DOCUMENTS 3,046,549 A 7/1962 Kalmus
3,121,228 A 2/1964 Kalmus
(Continued)

OTHER PUBLICATIONS

Bruin et al, "Most Accurate Drilling Guidance by Dead-Reckoning using High Precision Optical Gyroscopes", Presented Nov. 2, 2006 at No-Dig 2006 in Brisbane, Australia.
(Continued)

*Primary Examiner* — Brad Harcourt
(74) *Attorney, Agent, or Firm* — Pritzkau Patent Group LLC

(57) ABSTRACT

A boring tool that is moved by a drill string to form an underground bore. A transmitter transmits a time varying dipole field as a homing field from the boring tool. A pitch sensor detects a pitch orientation of the boring tool. A homing receiver is positionable at a target location for detecting the homing field to produce a set of flux measurements. A processing arrangement uses the pitch orientation and flux measurements with a determined length of the drill string to determine a vertical homing command for use in controlling depth in directing the boring tool to the target location such that the vertical homing command is generated with a particular accuracy at a given range between the transmitter and the homing receiver and which would otherwise be generated with the particular accuracy for a standard range, different from the particular range. An associated system and method are described.

14 Claims, 8 Drawing Sheets

Related U.S. Application Data continuation of application No. 13/761,632, filed on Feb. 7, 2013, now Pat. No. 9,422,804, which is a continuation of application No. 12/689,954, filed on Jan. 19, 2010, now Pat. No. 8,381,836.

(51) Int. Cl.
*E21B 7/04* (2006.01)
*E21B 44/00* (2006.01)

(56) References Cited

U.S. PATENT DOCUMENTS

| | | | |
|---|---|---|---|
| 3,868,565 | A | 2/1975 | Kuipers |
| 3,876,831 | A | 4/1975 | Wickham et al. |
| 3,983,474 | A | 9/1976 | Kuipers |
| 4,812,812 | A | 3/1989 | Flowerdew et al. |
| 4,881,083 | A | 11/1989 | Chau et al. |
| 5,002,137 | A | 3/1991 | Dickenson et al. |
| 5,258,755 | A | 11/1993 | Kuckes |
| 5,320,180 | A | 6/1994 | Ruley et al. |
| 5,513,710 | A | 5/1996 | Kuckes |
| 5,515,931 | A | 5/1996 | Kuckes |
| 5,585,726 | A | 12/1996 | Chau |
| 5,589,775 | A | 12/1996 | Kuckes |
| 5,646,524 | A | 7/1997 | Gilboa |
| 5,646,525 | A | 7/1997 | Gilboa |
| 5,657,826 | A | 8/1997 | Kuckes |
| 6,035,951 | A | 3/2000 | Mercer et al. |
| 6,223,826 | B1 | 5/2001 | Chau et al. |
| 6,250,402 | B1 | 6/2001 | Brune et al. |
| 6,285,190 | B1 | 9/2001 | Brune et al. |
| 6,380,732 | B1 | 4/2002 | Gilboa |
| 6,417,666 | B1 | 7/2002 | Mercer |
| 6,427,784 | B1 | 8/2002 | Archambeault et al. |
| 6,466,020 | B2 | 10/2002 | Kuckes et al. |
| 6,496,008 | B1 | 12/2002 | Brune et al. |
| 6,615,155 | B2 | 9/2003 | Gilboa |
| 6,626,252 | B1 | 9/2003 | Kuckes |
| 6,727,704 | B2 | 4/2004 | Brune et al. |
| 6,736,222 | B2 | 5/2004 | Kuckes et al. |
| 6,814,163 | B2 | 11/2004 | Kuckes |
| 6,868,921 | B2 | 3/2005 | Burrows et al. |
| 7,055,601 | B2 | 6/2006 | Barrow |
| 7,219,749 | B2 | 5/2007 | Kuckes |
| 7,425,829 | B2 | 9/2008 | Zeller et al. |
| 7,570,060 | B2 | 8/2009 | Zeller et al. |
| 7,772,849 | B2 | 8/2010 | Zeller et al. |
| 7,775,301 | B2 | 8/2010 | Brune et al. |
| 7,859,249 | B2 | 12/2010 | Zeller et al. |
| 8,381,836 | B2 | 2/2013 | Brune et al. |
| 10,107,090 | B2 * | 10/2018 | Brune ..... E21B 47/02224 |
| 2001/0038354 | A1 | 11/2001 | Gilboa |
| 2002/0005719 | A1 | 1/2002 | Gilboa et al. |
| 2002/0062203 | A1 | 5/2002 | Gilboa |
| 2003/0102868 | A1 | 6/2003 | Brune et al. |
| 2005/0077085 | A1 | 4/2005 | Zeller et al. |
| 2006/0225921 | A1 * | 10/2006 | Mercer ..... E21B 47/02216 175/45 |
| 2008/0047750 | A1 | 2/2008 | Burrows et al. |
| 2011/0062959 | A1 | 3/2011 | Zeller et al. |

OTHER PUBLICATIONS

Applied Physics, "Model 175 Steering Tool System User's Manual and Technical Guide", Jan. 2004, Applied Physics (Mountain View, CA).

Herb Susmann, Ben Smith, Jed Sheckler; RivCross Operating Manual Version 1.01; Mar. 2004, Vector Magnetics LLC.

* cited by examiner

ADVANCED UNDERGROUND HOMING SYSTEM, APPARATUS AND METHOD

This application is a continuation application of copending U.S. patent application Ser. No. 15/231,764, filed on Aug. 8, 2016, which is a continuation application of U.S. patent application Ser. No. 13/761,632 filed on Feb. 7, 2013 and issued as U.S. Pat. No. 9,422,804 on Aug. 23, 2016, which is a continuation application of U.S. patent application Ser. No. 12/689,954 filed on Jan. 19, 2010 and issued as U.S. Pat. No. 8,381,836 on Feb. 26, 2013, the disclosures of which are incorporated herein by reference.

BACKGROUND OF THE INVENTION

The present application is related generally to the field of underground directional drilling and, more particularly, to an advanced underground homing system, apparatus and method for directing a drill head to a homing target.

A boring tool is well-known as a steerable drill head that can carry sensors, transmitters and associated electronics. The boring tool is usually controlled through a drill string that is extendable from a drill rig. The drill string is most often formed of drill pipe sections, which may be referred to hereinafter as drill rods, that are selectively attachable with one another for purposes of advancing and retracting the drill string. Steering is often accomplished using a beveled face on the drill head. Advancing the drill string while rotating should result in the boring tool traveling straight forward, whereas advancing the drill string with the bevel oriented at some fixed angle will result in deflecting the boring tool in some direction. A number of approaches have been seen in the prior art for purposes of attempting to guide the boring tool to a desired location, a few of which will be discussed immediately hereinafter.

In one approach, the boring tool transmits an electromagnetic locating signal. Above ground, a portable detection device, known as a walkover detector, is movable so as to characterize the positional relationship between the walkover detector and the boring tool at a given time. The boring tool can be located, for example, by moving the walkover detector to a position that is directly overhead of the boring tool or at least to some unique point in the field of the electromagnetic locating signal. In some cases, however, a walkover locator is not particularly practical when drilling beneath some sort of obstacle such as, for example, a river, freeway or building. In such cases, other approaches may be more practical.

Another approach that has been taken by the prior art, which may be better adapted for coping with obstacles which prevent access to the surface of the ground above the boring tool, resides in what is commonly referred to as a "steering tool." This term has come to describe an overall system which essentially predicts the position of the boring tool, as it is advanced through the ground using a drill string, such that the boring tool can be steered from a starting location while the location of the boring tool is tracked in an appropriate coordinate system relative to the starting position. Arrival at a target location is generally determined by comparing the determined position of the boring tool with the position of the desired target in the coordinate system.

Steering tool systems are considered as being distinct from other types of locating systems used in horizontal directional drilling at least for the reason that the position of the boring tool is determined in a step-wise fashion as it progresses through the ground. Generally, in a traditional steering tool system, pitch and yaw angles of the drill-head are measured in coordination with extension of the drill string. From this, the drill-head position coordinates are obtained by numerical integration step-by-step from one location to the next. Nominal or measured drill rod lengths can serve as a step size during integration. One concern with respect to conventional steering tools is a tendency for positional error to accumulate with increasing progress through the ground up to unacceptable levels. This accumulation of positional error is attributable to measurement error in determining the pitch and yaw angles at each measurement location. One technique in the prior art in attempting to cope with the accumulation of positional error resides in attempting to measure the pitch and yaw parameters with the highest possible precision, for example, using an optical gyroscope in an inertial guidance system. Unfortunately, such gyroscopes are generally expensive.

Another approach that has been taken by the prior art, which is also able to cope with drilling beneath obstacles, is a homing type system. In traditional homing systems, the boring tool includes a homing transmitter that transmits an electromagnetic signal. A homing receiver is positioned at a target location or at least proximate to a target location such as, for example, directly above the target location. The homing receiver is used to receive the electromagnetic signal and to generate homing commands based on characteristics of the electromagnetic signal which indicate whether the boring tool is on a course that would ultimately cause it to be directed to the target location. Generally, identifying the particular location of the boring tool is not of interest since the boring tool will ultimately arrive at the target location if the operator follows the homing commands as they are issued by the system. Applicants recognize, however, that such traditional homing systems are problematic with respect to use at relatively long ranges between the homing receiver and the boring tool, as will be discussed in detail below.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, a system includes a boring tool that is moved by a drill string using a drill rig that selectively extends the drill string to the boring tool to form an underground bore such that the drill string is characterized by a drill string length which is determinable. In one aspect, a homing apparatus includes a transmitter, forming part of the boring tool, for transmitting a time varying dipole field as a homing field. A pitch sensor is located in the boring tool for detecting a pitch orientation of the boring tool. A homing receiver is positionable at least proximate to a target location for detecting the homing field to produce a set of flux measurements. A processing arrangement is configured for using the detected pitch orientation and the set of flux measurements in conjunction with a determined length of the drill string to determine a vertical homing command for use in controlling depth in directing the boring tool to the target location such that the vertical homing command is generated with a particular accuracy at a given range between the transmitter and the homing receiver and which would otherwise be generated with the particular accuracy for a standard range, that is different from the particular range, without using the determined length of the drill string. A display indicates the vertical homing command to a user. In one feature, the boring tool is sequentially advanced through a series of positions along the underground bore and, at each one of the positions (i) the pitch orientation is detected by the pitch sensor, (ii) the homing receiver produces the flux measurements and (iii) the drill string is of the determined length such that at least the set of flux measurements is subject to a measurement error and the processing arrangement is configured for determining the vertical homing command, at least in part, by compensating for the measurement error, which measurement error would otherwise accumulate from each one of the series of positions to a next one of the series of positions, to cause the particular range to be greater than the standard range.

In another aspect, a system includes a boring tool that is moved by a drill string using a drill rig that selectively extends the drill string to the boring tool to form an underground bore such that the drill string is characterized by a drill string length. One embodiment of a method includes transmitting a time varying dipole field from the boring tool as a homing field. A pitch orientation of the boring tool is detected using a pitch sensor located in the boring tool. A homing receiver is positioned at least proximate to a target location for detecting the homing field to produce a set of flux measurements. A length of the drill string is determined. A processor is configured for using the detected pitch orientation and the set of flux measurements in conjunction with the established length of the drill string to determine a vertical homing command for use in controlling depth in directing the boring tool to the target location such that the vertical homing command is generated with a particular accuracy at a given range between the transmitter and the homing receiver and which would be generated with the particular accuracy for a standard range, that is different from the particular range, without using the determined length of the drill string, and indicating the vertical homing command to a user. In one feature, the boring tool is sequentially advanced through a series of positions along the underground bore and, at each one of the positions (i) the pitch orientation is detected using the pitch sensor, (ii) the flux measurements are produced by the homing receiver and (iii) establishing the determined length of the drill string is established such that at least the set of flux measurements is subject to a measurement error. The vertical homing command is determined, at least in part, by compensating for the measurement error, which measurement error would otherwise accumulate from each one of the series of positions to a next one of the series of positions, to cause the particular range to be greater than the standard range.

In still another aspect, a system includes a boring tool that is moved by a drill string using a drill rig that selectively extends the drill string to the boring tool to form an underground bore such that the drill string is characterized by a drill string length which is determinable. A homing apparatus includes a transmitter, forming part of the boring tool, for transmitting a time varying electromagnetic homing field. A pitch sensor is located in the boring tool for detecting a pitch orientation of the boring tool. A homing receiver is provided that is positionable at least proximate to a target location for detecting the homing field to produce a set of flux measurements. A processing arrangement is configured for using the detected pitch orientation and the set of flux measurements in conjunction with a determined length of the drill string to determine a vertical homing command and a horizontal homing command such that the vertical homing command has a particular accuracy that is different from another accuracy associated with the horizontal homing command for use in controlling depth in directing the boring tool to the target location. In one feature, the particular accuracy of the vertical homing command is greater than the other accuracy of the horizontal homing command.

In yet another aspect, a system includes a boring tool that is moved by a drill string using a drill rig that selectively extends the drill string to the boring tool to form an underground bore such that the drill string is characterized by a drill string length which is determinable. A method includes transmitting a time varying electromagnetic homing field from the boring tool. A pitch orientation of the boring tool is detected. A homing receiver is positioned at least proximate to a target location for detecting the homing field to produce a set of flux measurements. The detected pitch orientation and the set of flux measurements are used in conjunction with a determined length of the drill string to determine a vertical homing command and a horizontal homing command such that the vertical homing command has a particular accuracy that is different from another accuracy associated with the horizontal homing command for use in controlling depth in directing the boring tool to the target location. In one feature, the particular accuracy of the vertical homing command is generated as being more accurate than the other accuracy of the horizontal homing command.

In a further aspect, a system includes a boring tool that is moved by a drill string using a drill rig that selectively extends the drill string to the boring tool to form an underground bore such that the drill string is characterized by a drill string length which is determinable and in which the boring tool is configured for transmitting an electromagnetic homing field. An improvement includes configuring an arrangement for using at least the electromagnetic homing field to determine a vertical homing command and a horizontal homing command such that the vertical homing command has a particular accuracy that is different from another accuracy associated with the horizontal homing command for use in controlling depth in directing the boring tool to the target location. In one feature, the arrangement is further configured for generating the particular accuracy of the vertical homing command as being more accurate than the other accuracy of the horizontal homing command.

In addition to the exemplary aspects and embodiments described above, further aspects and embodiments will become apparent by reference to the drawings and by study of the following descriptions.

BRIEF DESCRIPTION OF THE DRAWINGS

Exemplary embodiments are illustrated in referenced figures of the drawings. It is intended that the embodiments and figures disclosed herein are to be illustrative rather than limiting.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology such as, for example, upper/lower, front/rear, vertically/horizontally, inward/outward, left/right and the like may be adopted for purposes of enhancing the reader's understanding, with respect to the various views provided in the figures, and is in no way intended as being limiting.

Figures 1, 2:
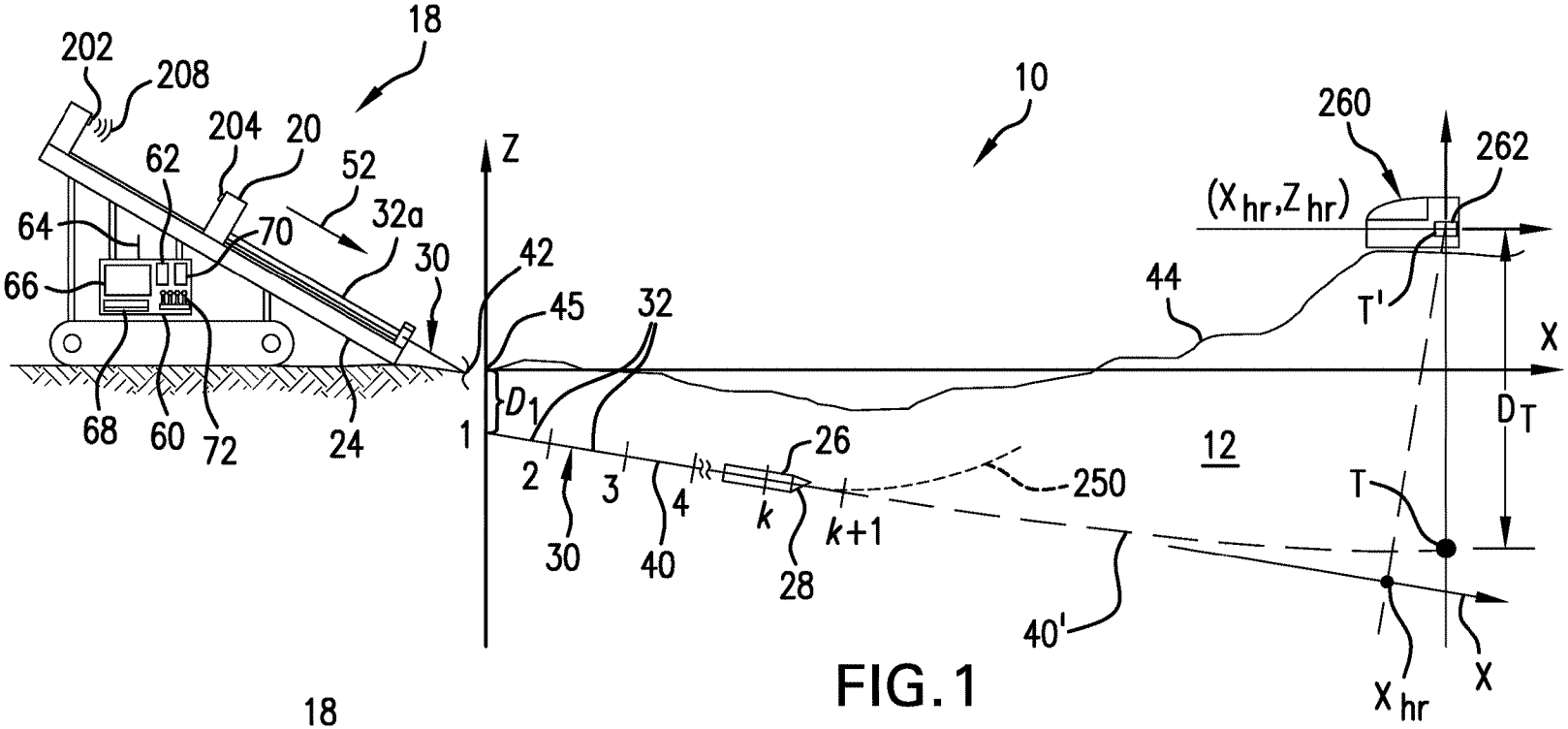
FIG. 1 is a diagrammatic view, in elevation, of a region in which a homing apparatus and associated method, according to the present disclosure, are used in a homing operation for purposes of causing a boring tool to home in on a target location.
FIG. 2 is a diagrammatic plan view of the region of FIG. 1 in which the homing apparatus and associated method are employed.

Turning now to the figures, wherein like components are designated by like reference numbers whenever practical, attention is immediately directed to FIGS. 1 and 2, which illustrate an advanced homing tool system that is generally indicated by the reference number 10 and produced according to the present disclosure. FIG. 1 is a diagrammatic elevational view of the system, whereas FIG. 2 is a diagrammatic plan view of the system, each figure showing a region 12 in which a homing operation is underway. System 10 includes a drill rig 18 having a carriage 20 received for movement along the length of an opposing pair of rails 22 which are, in turn, mounted on a frame 24. A conventional arrangement (not shown) is provided for moving carriage 20 along rails 22. A boring tool 26 includes an asymmetric face 28 (FIG. 1) and is attached to a drill string 30 which is composed of a plurality of drill pipe sections 32, several of which are indicated. It is noted that the drill string is partially shown due to illustrative constraints. Generally, the drill rig hydraulically pushes the drill string into the ground with selective rotation. Pushing with rotation is intended to cause the boring tool to travel straight ahead while pushing without rotation is intended to cause the boring tool to turn, based on the orientation of asymmetric face 28. A path 40 of the boring tool includes a series of positions that are designated as k=1,2,3,4 etc. as the boring tool is advanced through the ground. The current position of the boring tool is position k with the next position to be position k+1. The portion of path 40 along which the boring tool has already traveled is shown as a solid line while a dashed line 40', in FIG. 1, illustrates the potential appearance of the path ahead of the boring tool resulting from the homing procedure. The increment between the positions k and k+1 can correspond to the length of one pipe section, although this is not a requirement. Boring tool 26 enters the ground at 42, however, the subject homing process can begin at position k=1 at a depth $D_1$ below a surface 44 of the ground, where a point 45 on the surface of the ground serves as the origin of a coordinate system. As will be seen, the homing operation can be initiated at point 42 where the boring tool initially enters the ground. While a Cartesian coordinate system is used as the basis for the coordinate system employed by the various embodiments disclosed herein, it is to be understood that this terminology is used in the specification and claims for descriptive purposes and that any suitable coordinate system may be used.

As the drilling operation proceeds, respective drill pipe sections, which may be referred to interchangeably as drill rods, are added to the drill string at the drill rig. A most recently added drill rod 32*a* is shown on the drill rig. An upper end 50 of drill rod 32*a* is held by a locking arrangement (not shown) which forms part of carriage 20 such that movement of the carriage in the direction indicated by an arrow 52 (FIG. 1) causes section 32*a* to move therewith, which pushes the drill string into the ground thereby advancing the boring operation. A clamping arrangement 54 is used to facilitate the addition of drill pipe sections to the drill string. The drilling operation can be controlled by an operator (not shown) at a control console 60 which itself can include a telemetry section 62 connected with a telemetry antenna 64, a display screen 66, an input device such as a keyboard 68, a processor 70, and a plurality of control levers 72 which, for example, control movement of carriage 20.

Still referring to FIGS. 1 and 2, in one embodiment, system 10 can include a drill string measuring arrangement having a stationary ultrasonic transmitter 202 positioned on drill frame 24 and an ultrasonic receiver 204 with an air temperature sensor 206 (FIG. 2) positioned on carriage 20. It should be noted that the positions of the ultrasonic transmitter and receiver may be interchanged with no effect on measurement capabilities. Transmitter 202 and receiver 204 are each coupled to processor 70 or a separate dedicated processor (not shown). In a manner well known in the art, transmitter 202 emits an ultrasonic wave 208 that is picked up at receiver 204 such that the distance between the receiver and the transmitter may be determined to within a fraction of an inch by processor 70 using time delay and temperature measurements. By monitoring movements of carriage 20, in which drill string 30 is either pushed into or pulled out of the ground, and clamping arrangement 54, processor 70 can accurately track the length of drill string 30 throughout a drilling operation to within a particular measurement accuracy. While it is convenient to perform measurements in the context of the length of the drill rods, with measurement positions corresponding to the ends of the drill rods, it should be appreciated that this is not a requirement and the ultrasonic arrangement can provide the total length of the drill string at any given moment in time. Further, in another embodiment, the length of the drill string can be determined according to the number of drill rods multiplied by nominal rod length. In this case, the rod length may be of a nominal value subject to some manufacturing tolerance at least with respect to its length. In one version of this embodiment, the drill string measurement arrangement can count the drill rods. In another version of this embodiment, the operator can count the drill rods. Of course, in either case, the number of drill rods that is counted can be correlated to the length that is determined by ultrasonic measurement, although there is no requirement for precision overall drill string length measurement.

Referring to FIG. 1, boring tool 26 includes a mono-axial antenna (not shown) such as a dipole antenna oriented along an elongation axis of the boring tool and which is driven to emit a dipole magnetic homing signal 250 (only one flux line of which is partially shown). As an example of a boring tool incorporating such a mono-axial antenna in its transmitter arrangement, see FIG. 9 of U.S. Pat. No. 5,155,442 (hereinafter, the '442 patent) entitled POSITION AND ORIENTATION LOCATOR/MONITOR and its associated description. This latter patent is commonly owned with the present application and hereby incorporated by reference. As will be described in detail hereinafter, homing signal 250 is monitored by a homing receiver 260 which will be described in detail at an appropriate point hereinafter. The boring tool is equipped with a pitch sensor (not shown) for measurement of its pitch orientation as is described, for example, in the '442 patent. As is also well known, the pitch orientation and other parameters of interest can be modulated onto the homing signal for remote reception and decoding. In other embodiments, measured parameters can be transferred to the drill rig using a wire-in-pipe configuration such as is described, for example, in U.S. Pat. No. 7,150,329 entitled AUTO-EXTENDING/RETRACTING ELECTRICALLY ISOLATED CONDUCTORS IN A SEGMENTED DRILL STRING, which is commonly owned with the present application and incorporated herein by reference. The parameters may be used at the drill rig and/or transferred to a remote location, for example, by telemetry section 62. It is noted, however, that the measurement of yaw is not necessary and, therefore, there is no need for a yaw sensor in the boring tool. It is well known that yaw angle is a parameter that is generally significantly more difficult to measure, as compared to pitch orientation. Accordingly, there is some benefit associated with techniques such as described herein which do not rely on measured yaw orientation.

Figure 3:
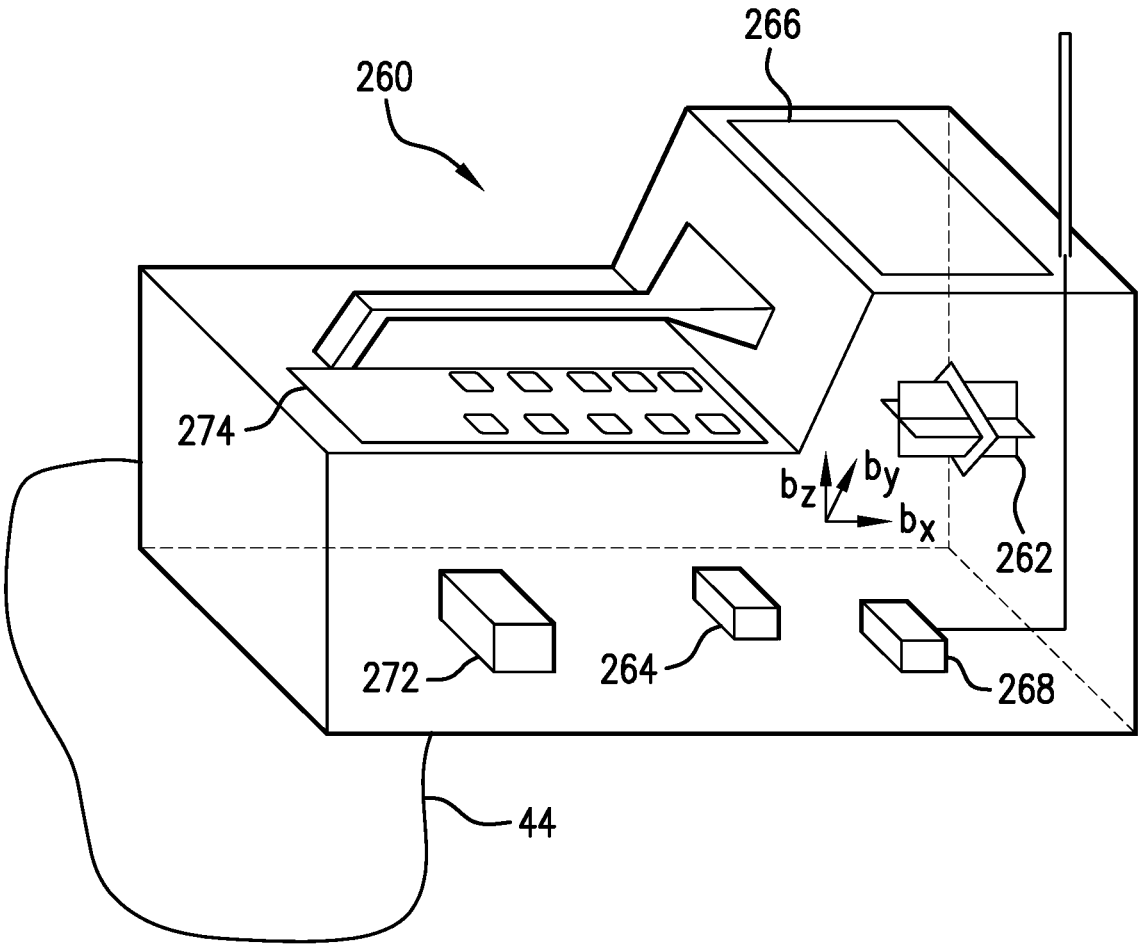
FIG. 3 is a diagrammatic view, in perspective, of a portable homing receiver that is produced according to the present disclosure, shown here to illustrate the various components of the homing receiver.

FIG. 3 is a diagrammatic view, in perspective, which illustrates details of one embodiment of portable homing receiver 260. The homing receiver includes a three-axis antenna cluster 262 for measuring three orthogonally arranged components of magnetic flux in a coordinate system that can be fixed to the homing receiver itself having axes designated as $b_x$, $b_y$ and $b_z$ and, of course, transformed to another coordinate system such as what may be referred to as a global coordinate system in the context of which the homing operation can be performed. In one embodiment, the global coordinate system can be the X,Y,Z. One useful antenna cluster contemplated for use herein is disclosed by U.S. Pat. No. 6,005,532 entitled ORTHOGONAL ANTENNA ARRANGEMENT AND METHOD which is commonly owned with the present application and is incorporated herein by reference. Antenna 262 is electrically connected to a receiver section 264 which can include amplification and filtering circuitry, as needed. Homing receiver 260 further may include a graphics display 266, a telemetry arrangement 268 having an antenna 270 and a processing section 272 interconnected appropriately with the various components. The processing section can include one or more microprocessors, DSP units, memory and other components, as needed. It is noted that, for the most part, inter-component cabling has not been illustrated in order to maintain illustrative clarity, but is understood to be present and may readily be implemented by one having ordinary skill in the art in view of this overall disclosure. It should be appreciated that graphics display 266 can be a touch screen in order to facilitate operator selection of various buttons that are defined on the screen and/or scrolling can be facilitated between various buttons that are defined on the screen to provide for operator selections. Such a touch screen can be used alone or in combination with an input device 274 such as, for example, a keypad. The latter can be used without the need for a touch screen. Moreover, many variations of the input device may be employed and can use scroll wheels and other suitable well-known forms of selection device. The telemetry arrangement and associated antenna are optional. The processing section can include components such as, for example, one or more processors, memory of any appropriate type and analog to digital converters. Generally, the homing receiver can be configured for direct placement on surface 44 of the ground, however, an ultrasonic transducer (not shown) can be provided for measuring the height of the homing receiver above the surface of the ground. One highly advantageous ultrasonic transducer arrangement is described, for example, in the above incorporated '442 patent.

As will be further described, Applicant recognizes that the accuracy of homing commands depends directly on the accuracy of fluxes measured at the homing receiver. Since dipole field signal strength (see item 250, in FIG. 1)

decreases in inverse proportion to distance to the third power, homing accuracy can diminish rapidly with relatively larger distances between the homing transmitter of boring tool 26 and homing receiver 260. In this regard, it should be appreciated that the weakest signal and, hence, the lowest accuracy in a typical homing procedure will be encountered at the start of the operation when separation between the homing transmitter and the homing receiver is usually at a maximum. In a conventional homing system, this initial separation can be beyond the range at which the homing receiver is capable of receiving the homing signal.

The homing technique and apparatus disclosed herein increases the range over which vertical homing is accurate. Accurate and useful homing commands can be generated over distances much larger than the typical range of 40 feet or so, using a typical battery powered homing transmitter. At a given range between the boring tool and the homing receiver, vertical homing accuracy is remarkably enhanced by using flux measurements in conjunction with integrating pitch for a determined drill string length, as will be further discussed at an appropriate point below.

Nomenclature

The following nomenclature is used in embodiments of the homing procedure described herein and is provided here as a convenience for the reader.

b=flux magnitude for unit boring tool transmitter dipole strength $b_X$,$b_Z$=flux components in the X,Z-directions $D_1$=initial boring tool transmitter depth $D_T$=target depth below homing receiver H=observation coefficient matrix I=identity matrix K=Kalman gain $L_R$=average drill rod length P=error covariance matrix $Q_k$=discrete process noise covariance matrix $R_M$=observation error covariance matrix $\vec{R}$=position vector from boring tool transmitter antenna center to the center of the homing receiver antenna s=arc length along drill string axis $\vec{v}_b$=vector of flux measurement error $\vec{v}_{hr}$=vector of homing receiver position error $\vec{x}$=state variables vector $x_{hr}$=homing receiver x-position in boring tool transmitter coordinates X,Z=coordinate axes of vertical plane in which homing commands are generated or position coordinates in this plane $X_{hr}$,$Z_{hr}$=homing receiver position $X_T$,$Z_T$=target position $\vec{w}_k$=process noise vector $\vec{Z}$=measurement vector δX,δZ=position state variables $\delta X_{hr}$,$\delta Z_{hr}$=homing receiver antenna position increments δφ=pitch angle increment ΔY,ΔZ=horizontal and vertical homing commands φ=pitch angle $\Phi_k$=discrete state equation transition matrix σ=standard deviation $\sigma_\Phi$=pitch measurement error $\sigma_{b_X}$,$\sigma_{b_Y}$=flux measurement errors $\sigma_{X_{hr}}$,$\sigma_{Z_{hr}}$=homing receiver position measurement errors $\sigma_{X_1}$,$\sigma_{Z_1}$=initial boring tool transmitter position error $\sigma^2$=variance, square of standard deviation Subscripts est estimated value ex exact value hr Homing receiver k k-th transmitter position m measured T target 1 initial position of boring tool where homing is initiated Superscripts $(\dot{\ }) \quad \frac{d}{ds}$ $(\ )^-$ indicates last available estimate $(\ )'$ transpose $(\ )^*$ nominal drill path $\hat{\vec{x}}$ state variables vector estimate Referring to FIG. 1, prior to homing, the user may place homing receiver 260 on the ground ahead of the homing transmitter and above a specified target location T, pointing in the drilling direction in one embodiment. Note that the receiver x axis faces to the right in the view of FIG. 1. That is, the x axis of the receiver, along which flux $b_x$ is measured, faces away from the drill rig at least approximately in the drilling direction. In another embodiment, the center of tri-axial antenna 262 of the homing receiver may be chosen as a target T'. This set-up procedure determines an X,Z coordinate system used during homing (FIG. 2) where X is horizontal and Z is vertical. A Y axis extends horizontally and orthogonal to the X,Z plane completing a right handed Cartesian coordinate system. The use of this particular coordinate system which may be referred to herein as a master or global coordinate system, should be considered as exemplary and not limiting. Any suitable coordinate system may be used including Cartesian coordinate systems having different orientations and polar coordinate systems. It should be appreciated that the drill path is not physically confined to the X,Z plane such that homing along a curved path can be performed. The technique described herein, however, does not account for divergence of the boring tool out of the X,Z plane or for yaw angles out of the X,Z plane as represented by boring tool 26' (shown in phantom in FIG. 2) for purposes of producing enhanced vertical homing commands while still producing remarkable results. At the time of setup, the X,Z axes define a vertical plane that contains the center of the transmitter antenna at the start of homing and the center of antenna 262 of homing receiver 260. These axes can remain so defined for the remainder of the homing procedure. In the present example, the origin of this system is located at point 45 on the surface of the ground above the center of the homing transmitter antenna in boring tool 26 at position k=1 with the boring tool at a depth $D_1$. The depth at $D_1$ can be measured, for example, by a walkover locator or using a tape-measure if the initial position of the boring tool has been exposed. Hence, the initial homing transmitter position becomes $$X_1=0 \tag{1}$$

$$Z_1=-D_1 \tag{2}$$

In an embodiment where the origin of the coordinate system is defined at point 42, where the boring tool enters the ground, the origin of the coordinate system is at the center of the transmitter antenna with $D_1$=0.

Homing receiver position coordinates designated as $X_{hr}$, $Z_{hr}$ can be measured before homing begins. In addition, the average length of drill rods $L_R$ can determined for use in embodiments where the drill rig does not monitor the length of the drill string. For purposes of the present description, it will be assumed that drill rods are to be counted and that homing command determinations are made on a rod by rod basis such that the average drill rod length is relevant. The user can specify the depth of the target $D_T$ below the homing receiver so that target position coordinates, designated as $X_T$,$Z_T$, can be obtained from $$X_T=X_{hr} \tag{3}$$

$$Z_T=Z_{hr}-D_T \tag{4}$$

During homing, flux components are measured using antenna 262 of the homing receiver for use in conjunction with the measured pitch, designated as $\phi$, of the boring tool at each k position. The homing system utilizes an estimate of pitch measurement uncertainty $\sigma_\phi$ and of the measurement uncertainties of the 2 fluxes in the vertical X,Z plane which are denominated as $\sigma_{b_X}$,$\sigma_{b_Z}$, respectively. In addition, measurement uncertainties $\sigma_{Z_1}$,$\sigma_{X_{hr}}$,$\sigma_{Z_{hr}}$ are utilized where $\sigma_{Z_1}$ is the measurement uncertainty of depth $Z_1$ at position $k_1$, the value $\sigma_{X_{hr}}$ is the measurement uncertainty of the position of homing receiver 260 on the X axis, and the value $\sigma_{Z_{hr}}$ is the measurement uncertainty of the position of homing receiver 260 on the Z axis. Note that $\sigma_{X_1}=0$ since $X_1=0$ according to the definition above of the selected coordinate system. It should be appreciated that the various measurement uncertainties can be empirically obtained in a straightforward manner by evaluating and comparing repeat measurements of the quantity of interest. The uncertainty of locator position measurements is readily available from the manufacturer of distance measuring devices. Although the position of the homing receiver can be determined in any suitable manner, suitable handheld or tripod mounted laser devices are readily commercially available for measuring the homing receiver position coordinates. For example, the Leica Dist™ D5 can be used which has a range of over 300 feet and a built-in pitch sensor. In other embodiments, standard surveyor instrumentation can be used to determine the homing receiver position/coordinates prior to homing.

In one embodiment, the method is based on two types of equations, referred to as process equations and measurement equations. The following process equations are chosen where the dot symbol denotes derivatives with respect to arc length s along the axis of the drill rod or drill string:

$$\dot{X}=\cos\phi \tag{5}$$

$$\dot{Z}=\sin\phi \tag{6}$$

For vertical homing, the flux components $b_X$,$b_Z$ induced at the homing receiver are measured. They can be expressed in terms of transmitter position X,Z, homing receiver position $X_{hr}$,$Z_{hr}$ and pitch $\phi$. This leads to the following measurement equation written in vector form as $$\vec{B}=3x_{hr}R^{-5}\vec{R}-R^{-3}\vec{u} \tag{7}$$

where $$\vec{B}=(b_X,b_Z)' \tag{8}$$

$$\vec{R}=(X_{hr}-X,Z_{hr}-Z)' \tag{9}$$

$$R=|\vec{R}| \tag{10}$$

$$\vec{u}=(\cos\phi,\sin\phi)' \tag{11}$$

$$x_{hr}=\vec{u}'\vec{R} \tag{12}$$

Above, the prime symbol denotes the transpose of a vector.

Equations (5) and (6) are ordinary differential equations for the two unknown transmitter position coordinates X,Z. Vector Equation (7) can be written as two scalar equations for the flux components $b_X$ and $b_Z$ along the X and Z axes. It should be appreciated that these equations represent an initial value problem since Equations (5) and (6) can be integrated along arc length S starting from known initial values $X_1$,$Z_1$ at k=1. Equations (5), (6) and (7) couple flux measurements at the homing receiver to the transmitter position such that enhanced accuracy homing commands can be generated as compared to homing commands that are generated based solely on flux measurements, as in a conventional homing system.

Nonlinear Solution Procedures

The foregoing initial value problem can be solved using either a nonlinear solution procedure, such as the method of nonlinear least squares, the SIMPLEX method, or can be based on Kalman filtering. The latter will be discussed in detail beginning at an appropriate point below. Initially, however, an application of the SIMPLEX method will be described where the description is limited to the derivation of the nonlinear algebraic equations that are to be solved at each drill-path position. Details of the solver itself are well-known and considered as within the skill of one having ordinary skill in the art in view of this overall disclosure.

SIMPLEX Method

The present technique and other solution methods can replace the derivatives $\dot{X}$, $\dot{Z}$ in Equations (5) and (6) with finite differences that are here written as:

$$\dot{X}=\frac{X_{k+1}-X_k}{L_R} \tag{13}$$

$$\dot{Z}=\frac{Z_{k+1}-Z_k}{L_R} \tag{14}$$

Resulting algebraic equations read:

$$f_1=X_{k+1}-X_k-L_R\cos\phi_k=0 \tag{15}$$

$$f_2=Z_{k+1}-Z_k-L_R\sin\phi_k=0 \tag{16}$$

The flux measurement Equations (7-12) provide two additional algebraic equations written as:

$$f_3=b_{X_{k+1}}-3x_{hr}R_{k+1}^{-5}(X_{hr}-X_{k+1})+R_{k+1}^{-3}\cos\phi_{k+1}=0 \tag{17}$$

$$f_4=b_{Z_{k+1}}-3x_{hr}R_{k+1}^{-5}(Z_{hr}-Z_{k+1})+R_{k+1}^{-3}\sin\phi_{k+1}=0 \tag{18}$$

Here, transmitter pitch and fluxes are measured at the $(k+1)^{st}$ position. The distance between transmitter and homing receiver is obtained from the corresponding distance vector which reads $$\vec{R}_{k+1}=(X_{hr}-X_{k+1},Z_{hr}-Z_{k+1})' \tag{19}$$

Furthermore, we use $$R_{k+1}=|\vec{R}_{k+1}| \tag{20}$$

$$\vec{u}_{k+1}=(\cos\phi_{k+1},\sin\phi_{k+1})' \tag{21}$$

$$x_{hr}=\vec{u}_{k+1}'\vec{R}_{k+1} \tag{22}$$

Starting with the known initial values (Equations 1 and 2) at drill begin, the coordinates of subsequent positions along the drill path can be obtained by solving the above set of nonlinear algebraic equations (15-22) for each new tool position. The coordinates of position k+1 are determined iteratively beginning with some assumed initial solution estimate that is sufficiently close to the actual location to assure convergence to the correct position. One suitable estimate will be described immediately hereinafter.

An initial solution estimate is given by linear extrapolation of the previously predicted/last determined position to a predicted position. The linear extrapolation is based on Equations 5 and 6 and a given incremental movement $L_R$ of the homing tool from a $k^{th}$ position where:

$$(X_{k+1})_{est}=X_k+L_R \cos \phi_k \tag{23}$$

$$(Z_{k+1})_{est}=Z_k+L_R \sin \phi_k \tag{24}$$

Where the subscript (est) represents an estimated position. Application of the SIMPLEX method requires definition of a function that is to be minimized during the solution procedure. An example of such a function that is suitable in the present application reads:

$$F=\sum_{p=1}^{4} f_p^2 \tag{25}$$

As noted above, it is considered that one having ordinary skill can conclude the solution procedure under SIMPLEX in view of the foregoing.

Kalman Filter Solution

In another embodiment, a method is described for solving the homing command by employing Kalman filtering. The filter reduces the position error uncertainties caused by measurement minimizing the uncertainty of the vertical homing command in a least square sense thereby increasing the accuracy of the vertical homing command. The Kalman filter is applied in a way that couples flux measurements on a position-by-position basis with integration of pitch readings that are indicative of position coordinates in the X,Z plane, while accounting for error estimates relating to both flux measurement and pitch measurement.

It is worthwhile to note that a Kalman filter merges the solutions of two types of equations in order to obtain a single set of transmitter position coordinates along the drill path. In the present application, one set of equations (Equations 5 and 6) defines the rate of change of transmitter position along the drill path as a function of measured pitch angle. Equation (7) is based on the equations of a magnetic dipole inducing a flux at the homing receiver antenna. The Kalman filter provides enhanced homing commands by reducing the effect of errors in measuring fluxes, pitch, and homing receiver position.

The homing procedure can be initiated at a known boring tool position, as described above. Advancing the boring tool to the next location by one rod length provides an estimate of the new transmitter position that is limited to the X,Z plane by integrating measured pitch for known drill rod length increment. Consequently, this position estimate is improved by incorporating dipole flux equations. Accordingly, enhanced homing commands are generated responsive to both the flux measurements and the position of the boring tool in the vertical X,Z plane. This process is repeated along the drill path until the drill head has reached the target. It should be mentioned that the strength of the homing signal is generally initially weakest at the start of the homing procedure and increases in signal strength as the boring tool approaches the boring tool. The present disclosure serves not only to increase the accuracy of the homing signal but to increase homing range to distances that are unattainable in a conventional homing system for a given signal strength, as transmitted from the boring tool.

It is noted that the Kalman filter addresses random measurement errors. Therefore, fixed errors can be addressed prior to homing. For example, any significant misalignment of the pitch sensor in the boring tool with the elongation axis of the boring tool can be corrected. Such a correction can generally be performed easily by applying a suitable level such as, for example, a digital level to the housing of the boring tool and recording the difference between measured pitch and the pitch that is indicated by the pitch signal generated by the boring tool. Systematic error such as pitch sensor misalignment can be addressed in another way by using an identical roll orientation of the boring tool each time the pitch orientation is measured.

Nominal Drill Path

Assuming that the coordinates $X_k,Z_k$ are known for a current position of the boring tool whether by measurement of the initial position or by processing determinations on a position-by-position basis, an estimate for the next position of the boring tool can be obtained by linear extrapolation from k to k+1 for the incremental distance that is being used between adjacent positions. This estimate is a point on what is referred to herein as the nominal drill path, indicated by the superscript (*). In the present example, the incremental distance is taken as the average rod length, although this is not a requirement. The nominal drill path falls within the X,Z plane and ignores any out of plane travel of the boring tool. Hence, the coordinates for the estimated position become:

$$X_{k+1}^*=X_k+L_R \cos \phi_k \tag{26}$$

$$Z_{k+1}^*=Z_k+L_R \sin \phi_k \tag{27}$$

Here, the symbols $L_R,\phi_k$ denote average rod length and boring tool transmitter pitch at position k, respectively. It is noted that $L_R$ can correspond to any selected incremental distance between positions and may even vary from position to position.

While drill path positions can be found in one way by integrating Equations (5) and (6) starting from a specified initial guess without making use of flux Equation (7), solution accuracy may suffer from the following errors:

Integration errors due to pitch measurement errors, especially at relatively long ranges between the homing receiver and the initial transmitter position, Numerical integration errors, and Modeling inaccuracy since process Equations (5) and (6) might serve only as an approximation for some drilling scenarios.

State Variables

The Kalman Filter adds correction terms δX, δZ to the nominal drill path so that the transmitter position coordinates become:

$$X_{k+1}=X_{k+1}^*+\delta X_{k+1} \tag{28}$$

$$Z_{k+1}=Z_{k+1}^*+\delta Z_{k+1} \tag{29}$$

The vector containing δX, δZ is denominated as the vector of state variables, given as:

$$\vec{x}=(\delta X,\delta Z)' \tag{30}$$

The vector of state variables is governed by a set of state equations derived from Equations (5) and (6) by linearization, given as:

$$\vec{x}_{k+1}=\Phi_k\vec{x}_k+\vec{w}_k \tag{31}$$

where $$\vec{w}_k=L_R\vec{G}_k\delta\phi_k \tag{32}$$

$$\Phi_k=I \tag{33}$$

$$\vec{G}_k=(-\sin\phi_k,\cos\phi_k)' \tag{34}$$

Above, the vector $\vec{w}_k$ of Equation (19) is the process noise that depends on pitch measurement error and on vector $\vec{G}_k$ which in turn is a function of pitch. The covariance of $\vec{w}_k$ is the so-called discrete process noise covariance matrix $Q_k$ which plays an important role in Kalman filter analysis, given as:

$$Q_k=\mathrm{cov}(\vec{w}_k) \tag{35}$$

$$Q_k=L_R^2\vec{G}_k\sigma_\phi^2\vec{G}'_k \tag{36}$$

Even though $Q_k$ is defined analytically it could be manipulated empirically in order to increase solution accuracy for some applications. One convenient method to achieve this is to multiply $Q_k$ by the factor $F_E$ whose value is determined empirically by numerical experimentation. The best value of $F_E$ provides the most accurate predictions of the vertical homing command.

Linearization of the flux measurement equations about the nominal drill path results in the so-called observation equations, given in vector notation as:

$$\vec{z}=H\vec{x}+\vec{v}_b+\vec{v}_{hr} \tag{37}$$

Application to Equations (7-12) provides the following details of vector $\vec{z}$ and matrix H:

$$\vec{z}=(b_{X_m}-b_X^*,b_{Z_m}-b_Z^*)' \tag{38}$$

$$H=3x_{hr}R^{-7}(5\vec{R}\vec{R}'-R^2I)-3R^{-5}(\vec{R}\vec{u}'+\vec{u}\vec{R}') \tag{39}$$

$$x_{hr}=\vec{u}'\vec{R} \tag{40}$$

$$\vec{u}=(\cos\phi,\sin\phi)' \tag{41}$$

$$\vec{R}=(X_{hr}-X^*,Z_{hr}-Z^*) \tag{42}$$

$$R=|\vec{R}| \tag{43}$$

Note that $b_X^*,b_Z^*$ are the fluxes induced at the homing receiver by the transmitter on the nominal drill path $X^*,Z^*$. These fluxes can be determined using Equations (7-12) with $\vec{R}=(X_{hr}-X^*,Z_{hr}-Z^*)'$. Fluxes $b_{X_m},b_{Z_m}$ are the actual fluxes measured at the homing receiver with the boring tool transmitter in its actual position along the borehole, which can be yawed and/or positioned out of the X,Z plane.

The terms $\vec{v}_b$, $\vec{v}_{hr}$ represent vectors of flux measurement errors and homing receiver position errors, respectively. The observation error covariance matrix $R_M$, also used by the Kalman filter loop, is given by:

$$R_M=\mathrm{cov}(\vec{v}_b+\vec{v}_{hr}) \tag{44}$$

$$R_M=\begin{bmatrix}\sigma_{b_X}^2 & 0\\ 0 & \sigma_{b_Z}^2\end{bmatrix}+H\begin{bmatrix}\sigma_{X_{hr}}^2 & 0\\ 0 & \sigma_{Z_{hr}}^2\end{bmatrix}H' \tag{45}$$

State variables $\vec{x}$ and error covariance matrix P are initialized at the new position along the drill path by setting $$\hat{\vec{x}}_{k+1}=(0,0)' \tag{46}$$

$$P_{k+1}^-=P_k+Q_k \tag{47}$$

Here, the superscript $(\ )^-$ indicates the last available estimate of P.

The process of updating P begins with $P_1$ at the initial homing position $X_1,Z_1$. Its value is given as $$P_1=\begin{bmatrix}\sigma_{X_1}^2 & 0\\ 0 & \sigma_{Z_1}^2\end{bmatrix} \tag{48}$$

The classical, well documented version of the Kalman filter loop is chosen as a basis for the current homing tool embodiment. It is made up of three steps:

Kalman gain is given as:

$$K=P^-H'(HP^-H'+R_M)^{-1} \tag{49}$$

Update state variables:

$$\hat{\vec{x}}=\hat{\vec{x}}^-+K(\vec{z}-H\hat{\vec{x}}^-) \tag{50}$$

Update error covariance matrix:

$$P=(I-KH)P^- \tag{51}$$

Above, the symbol $\hat{\vec{x}}$ denotes a state variables estimate.

Equations (36-38) define a standard Kalman filter loop, for instance, as documented by Brown and Hwang, "Introduction to Random Signals and Applied Kalman Filtering", 1997.

Homing Commands

The vertical homing command in this embodiment is given by the vertical distance between transmitter and target:

$$\Delta Z=Z-Z_T \tag{52}$$

The horizontal homing command is defined as the ratio of horizontal fluxes measured at the homing receiver.

$$\Delta Y=\frac{b_{Y_m}}{b_{X_m}} \tag{53}$$

Figure 4:
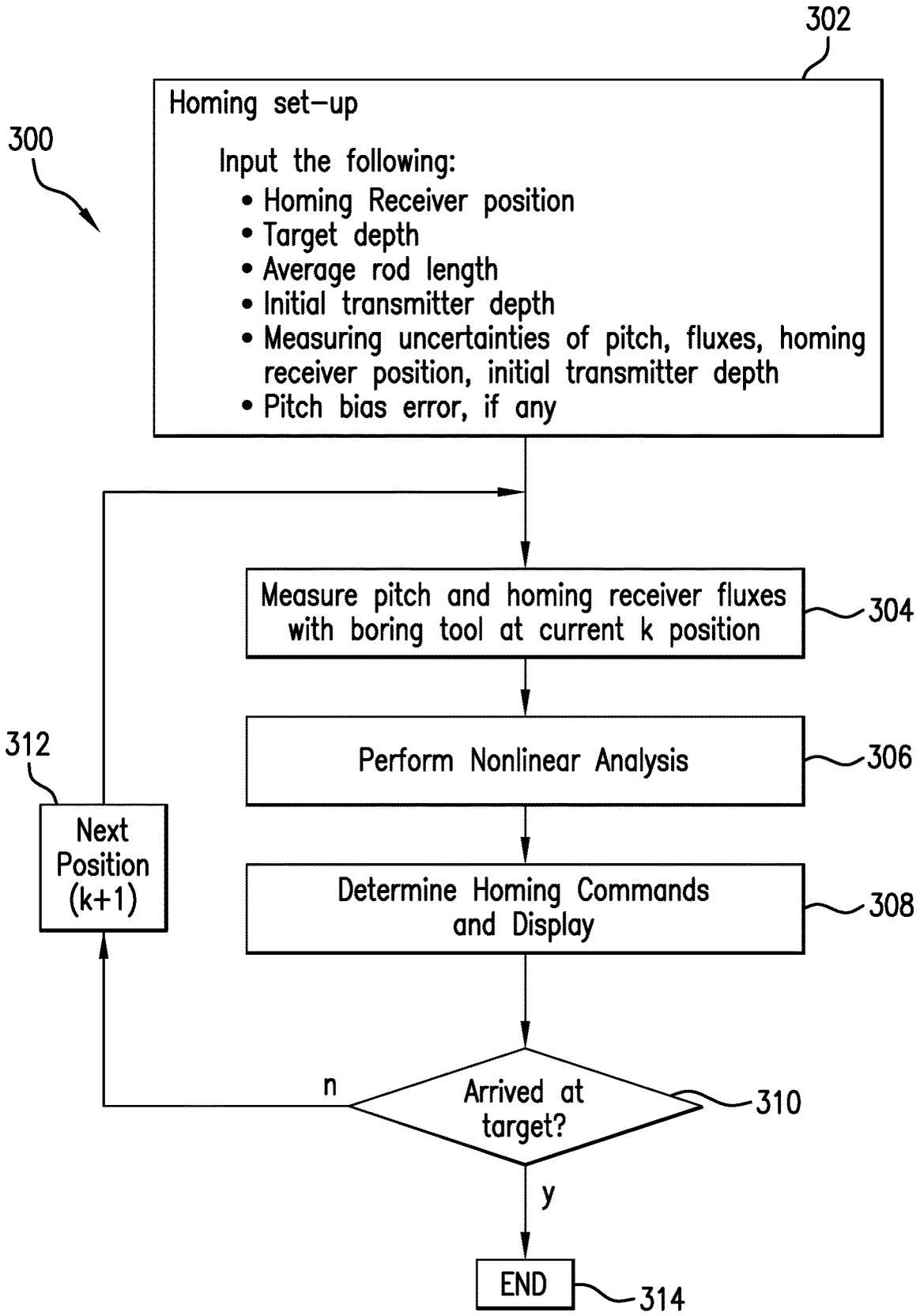
FIG. 4 is a flow diagram which illustrates one embodiment of a homing method according to the present disclosure.

Attention is now directed to FIG. 4 which illustrates one exemplary embodiment of a method according to the present disclosure, generally indicated by the reference number 300. The method begins at step 302 in which various set-up information is provided. It is noted that these items have been described above insofar as their determination and the reader is referred to these descriptions. The information includes the position of the homing receiver, the depth of the target, the average length of the drill rods to be used in an embodiment which relies on the drill rod length as an incremental movement distance; the initial transmitter depth; measurement uncertainties of pitch readings, flux measurements, homing receiver position and the initial transmitter depth; and the pitch bias error, if any.

At 304, for the current position of the boring tool, the pitch is measured as well as fluxes at the homing receiver using antenna 262. Note that the boring tool can be oriented at an identical roll orientation each time a pitch reading is taken if such a technique is in use for purposes of compensating for pitch bias error.

At 306, the selected nonlinear solution procedure such as, for example, the aforedescribed Kalman filter analysis is performed for the current position of the boring tool.

At 308, the homing commands are determined based on the nonlinear solution procedure and the homing commands are displayed to the user.

At 310, a determination is made as to whether the boring tool has arrived at the target position. If not, the boring tool is moved by step 312 to the next position and the process repeats by returning to step 304. If, on the other hand, the determination is made that the boring tool has arrived at the target, the procedure ends at 314.

Figure 5:
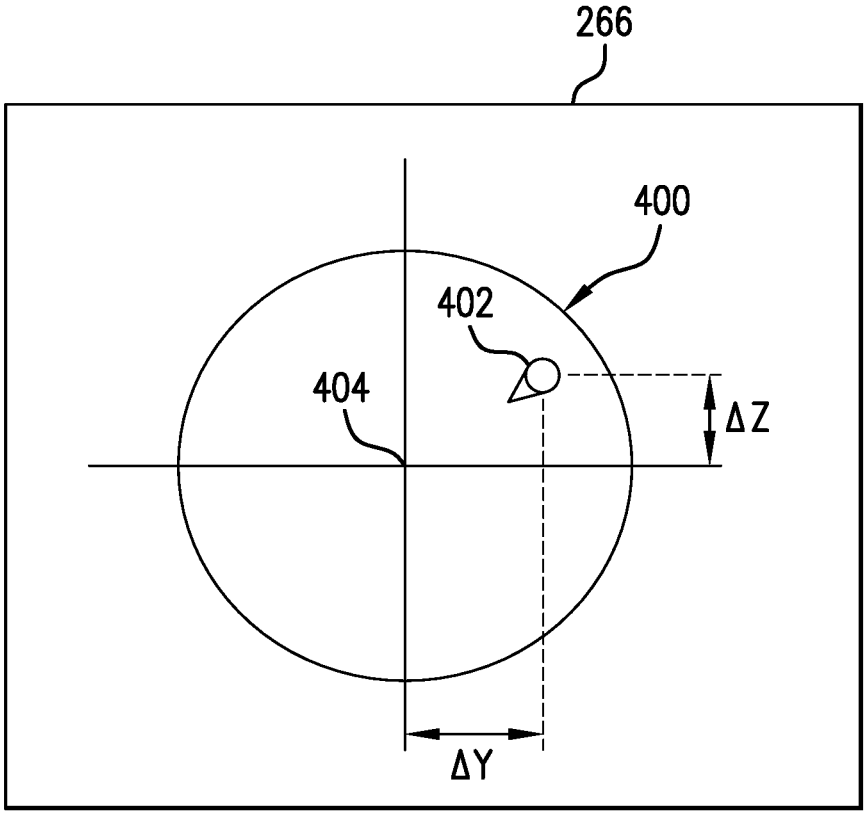
FIG. 5 is a diagrammatic illustration of one embodiment of the appearance of a screen for displaying a homing command generated according to the present disclosure.

The homing commands can be displayed, for example, as seen in FIG. 5 where the objective is to minimize ΔY, ΔZ when the target is approached. In particular, a screen shot of one embodiment of the appearance of display 266 is shown having a crosshair arrangement 400 with a homing pointer 402. In the present example, the boring tool should be steered down and the left by the operator of the system according to homing pointer 402. That is, pointer 402 shows the direction in which the boring tool should be directed to home in on the homing receiver. The position of the homing indicator on the display is to be established by the determined values of ΔY and ΔZ, as described above. When homing indicator 402 is centered on cross-hairs 404, the boring tool is on course and no steering is required.

Numerical simulations of vertical homing, according to the disclosure above, are now presented assuming pitch, fluxes and homing receiver position can be measured with the following accuracies:

$$\sigma_{\Phi}=0.5 \text{ deg} \tag{54}$$

$$\sigma_{b_X}=2.4e-6 \text{ ft}^{-3} \tag{55}$$

$$\sigma_{b_Z}=2.4e-6 \text{ ft}^{-3} \tag{56}$$

$$\sigma_{X_{hr}}=0.1 \text{ ft} \tag{57}$$

$$\sigma_{Z_{hr}}=0.1 \text{ ft} \tag{58}$$

The chosen initial position accuracy depends on the location where homing begins.

$$\sigma_{X_1}=0 \text{ for } X_1=0 \tag{59}$$

$$\sigma_{Z_1}=0 \text{ for } Z_1=0 \tag{60}$$

or $$\sigma_{Z_1}=0.1 \text{ ft for } Z_1=-D_1 \tag{61}$$

Figure 6A:
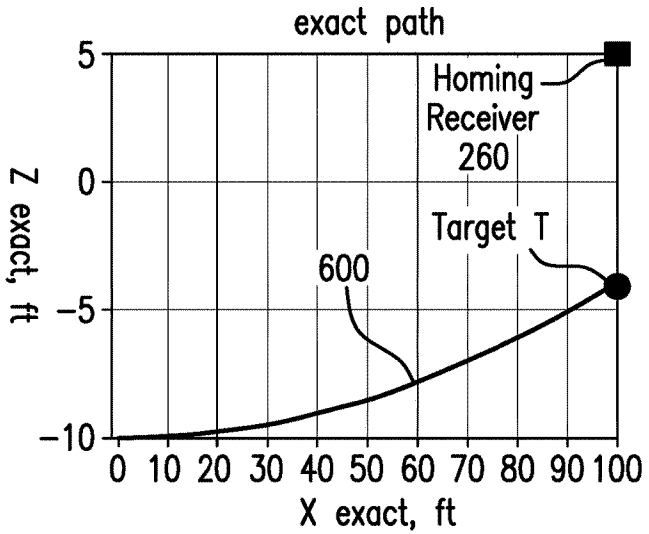
FIG. 6*a* is a plot which illustrates a simulated drill path in an elevational view for use in demonstrating the accuracy of vertical homing commands produced according to the present disclosure.

Referring to FIGS. 6*a*-6*d*, a numerical simulation is provided based on the Kalman filter embodiment described above and the accuracies set forth by Equations (54-61), as applicable. FIG. 6*a* is a plot, in elevation, showing the X,Z plane and an exact path in the plane that is indicated by the reference number 600. The homing procedure is initiated at coordinates (0,−10) and target T is located at coordinates (100,−4). The equation of this exemplary drill path is given as:

$$Z_{ex}=-10+(6e-4)X_{ex}^2,\text{ft} \tag{62}$$

Figure 6B:
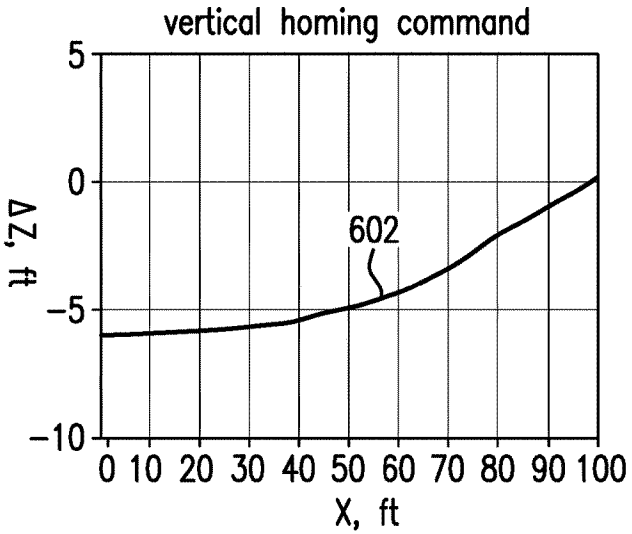
FIG. 6*b* is a plot of the vertical homing command along the simulated drill path of FIG. 6*a*, which vertical homing command is produced according to the present disclosure.
Figure 6C:
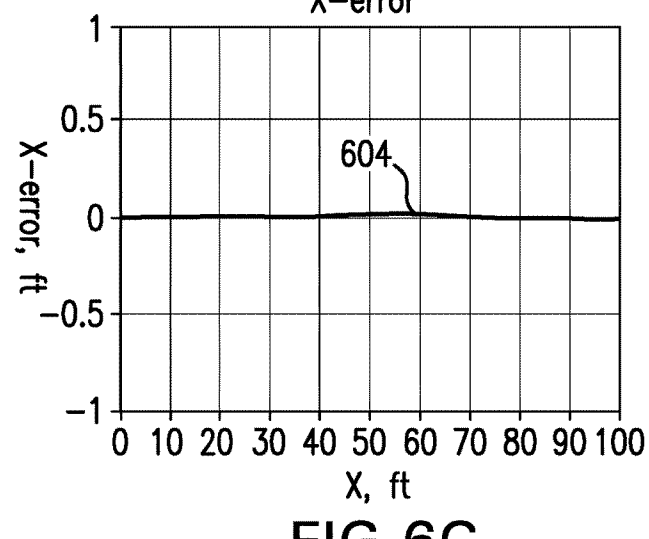
FIG. 6*c* is a plot of X axis error along the X axis illustrating a difference between actual position along the X axis and determined position for the drill path of FIG. 6*a*.
Figure 6D:
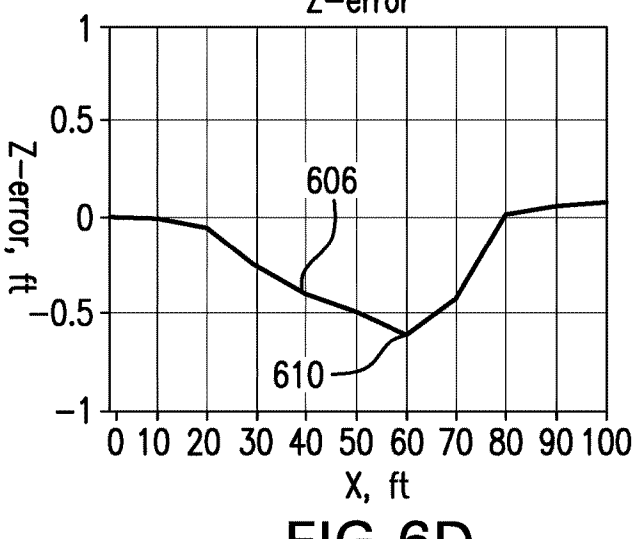
FIG. 6*d* is a plot of Z axis error along the X axis illustrating a difference between actual position along the Z axis and determined position for the drill path of FIG. 6*a*.

Here the subscript (ex) stands for "exact." The example represents homing with a 100 foot range of effective vertical homing and a ten foot average drill rod length. It should be appreciated that this drill path is representative of a homing distance that is generally well beyond the standard range of a conventional homing system at the start of drilling. The range of a conventional homing system is typically about 40 feet with a typical transmitter and a typical receiver. FIG. 6*b* is another plot of the X,Z plane showing a plot 602 of the value of the vertical homing command. It should be appreciated that the magnitude of the homing command controls the amount of steering that is needed. Thus, the magnitude of the homing command starts decreasing significantly at around X=40 feet and has the value zero at X=100 feet, where the boring tool arrives at the target. FIG. 6*c* shows a plot of the value of X error 604 along the length of the drill path. The X error is the difference between the actual position of the boring tool along this axis and the determined position of the boring tool along the X axis. FIG. 6*d* shows a plot of Z error 606 along the length of the drill path. The Z error is the difference between the actual position of the boring tool along this axis and the determined position of the boring tool along the Z axis. It is noted that a negative going peak 610 is present in plot 606 at X=60 feet, representing a maximum vertical position error of approximately 7 inches at a distance equivalent to 4 rod length laterally away from the target. This distance provides sufficient steering reserves to accurately reach the target. The X position error along the drill path is less than 1 inch. Note in this example that homing started at a depth of 10 ft. At X=100 feet, the Z error value is near zero.

Figure 7B:
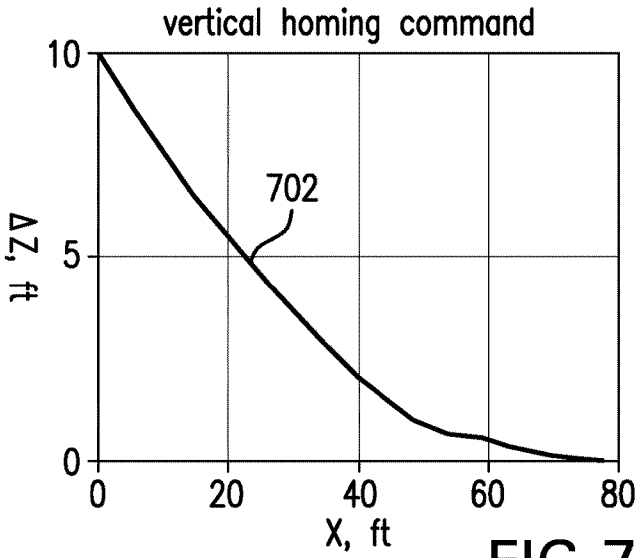
FIG. 7*b* is a plot of the vertical homing command along the simulated drill path of FIG. 7*a*, which vertical homing command is produced according to the present disclosure.
Figure 7A:
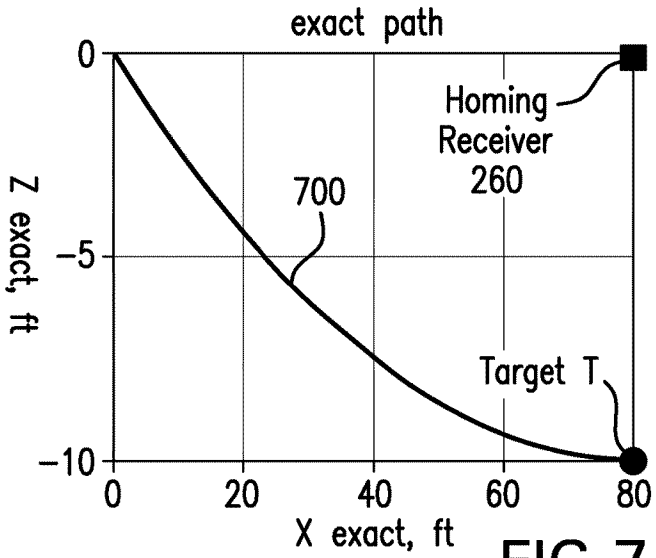
FIG. 7*a* is a another plot which illustrates another simulated drill path in an elevational view for use in demonstrating the accuracy of vertical homing commands produced according to the present disclosure.
Figure 7D:
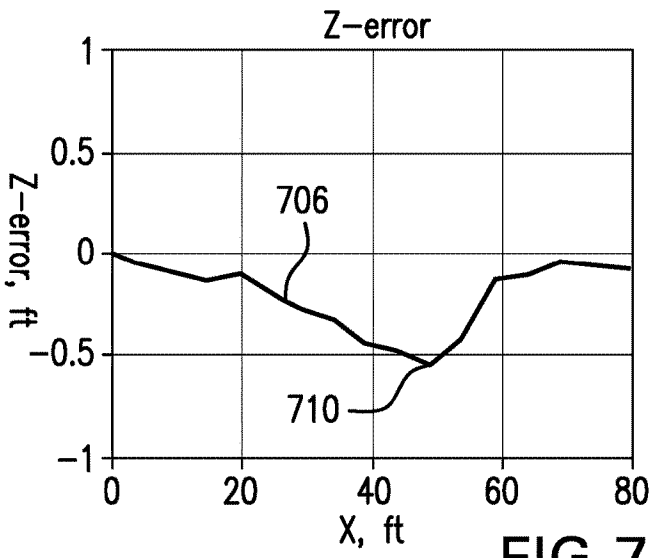
FIG. 7*d* is a plot of Z axis error along the X axis illustrating a difference between actual position along the Z axis and determined position for the drillpath of FIG. 7*a*.
Figure 7C:
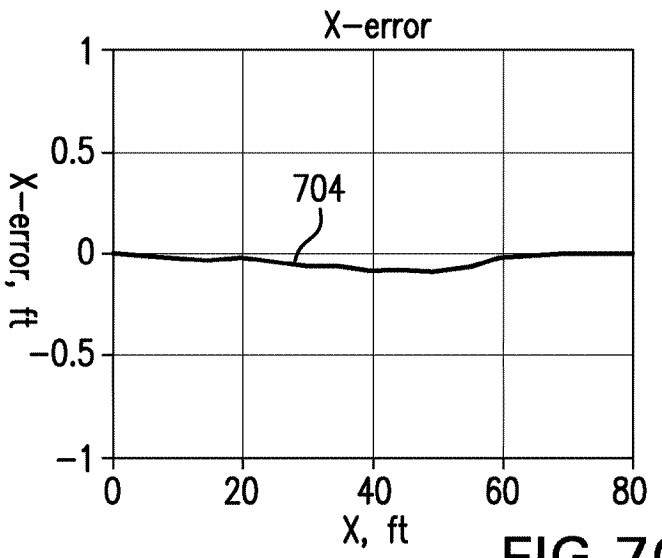
FIG. 7*c* is a plot of X axis error along the X axis illustrating a difference between actual position along the X axis and determined position for the drillpath of FIG. 7*a*.

Referring to FIGS. 7*a*-7*d*, another numerical simulation is provided based on the Kalman filter embodiment described above and the accuracies set forth by Equations (54-61), as applicable. FIG. 7*a* is a plot, in elevation, showing the X,Z plane and an exact path in the plane that is indicated by the reference number 700. The homing procedure is initiated at coordinates (0,0) and target T is located at coordinates (80,−10). Again, at the incept of drilling, this example illustrates a range that is generally well beyond the range that is available in a conventional homing system. The equation of this exemplary drill path is given as:

$$Z_{ex}=-0.25X_{ex}+0.0015625X_{ex}^2 \tag{63}$$

Where the subscript (ex) again stands for "exact." The example represents homing with an 80 foot range of effective vertical homing and a five foot average drill rod length. FIG. 7*b* is another plot of the X,Z plane showing a plot 702 of the value of the vertical homing command. As is the case in all of the examples presented here, the magnitude of the homing command controls the amount of steering that is needed. Thus, the magnitude of the homing command starts decreasing significantly at around X=50 feet and has the value zero at X=80 feet, where the boring tool arrives at the target. FIG. 7*c* shows a plot of the value of X error 704 along the length of the drill path. It is noted that the X error is less than approximately 2 inches for the entire length of the drill path. FIG. 7*d* shows a plot of Z error 706 along the length of the drill path. It is noted that a negative going peak 710 is present in plot 706 at X=48 feet representing a maximum Z error of about 6 inches at around 30 feet from the target. At X=80 feet, the Z error value is near zero.

The previous examples assume that during the homing process the transmitter moves in the vertical X,Z plane and that any three-dimensional effect on vertical homing commands is negligible. In the next example, it will be shown that homing commands remain accurate even when the transmitter leaves the vertical plane and/or yaws with respect to the vertical plane. The lateral offset may reduce lateral homing effectiveness at initial, greater range from the target but lateral effectiveness improves when the transmitter approaches the target, as will be seen.

Figure 8A:
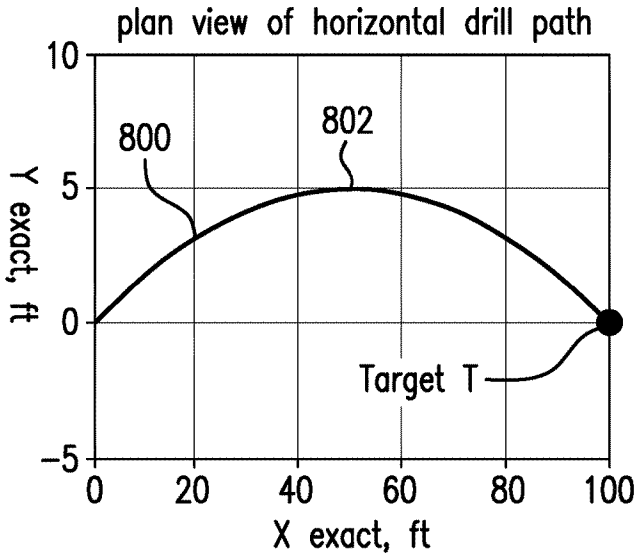
FIG. 8*a* is a plot which illustrates a simulated drill path in a plan view which is used in conjunction with the elevational view of FIG. 6*a* to form an overall three-dimensional simulated drill path for use in demonstrating the effectiveness of vertical homing commands produced according to the present disclosure in view of significant yaw and lateral diversion of the boring tool.

Turning to FIGS. 8*a*-*d*, a three-dimensional test case will now be described. FIG. 8*a* illustrates a plot of a horizontal drill path 800 that is added to the vertical drill path of FIG.

6*a* and given by Equation (49). A ten foot average drill rod length is used in the present example. The lateral drill path is given by:

$$Y_{ex}=0.2X_{ex}-(2e-3)X_{ex}^2 \quad (64)$$

Figure 8B:
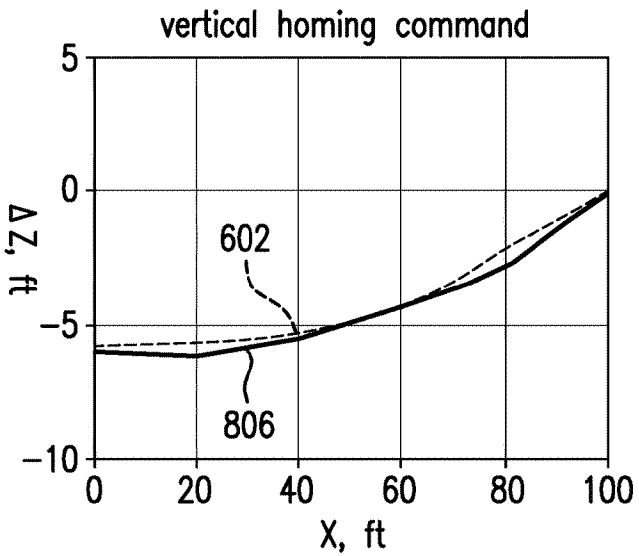
FIG. 8*b* is a plot of the vertical homing command along the simulated drill path cooperatively defined by FIGS. 6*a* and 8*a*, which vertical homing command is produced according to the present disclosure and with the vertical homing command of FIG. 6*b* shown as a dashed line for purposes of comparison.
Figure 8C:
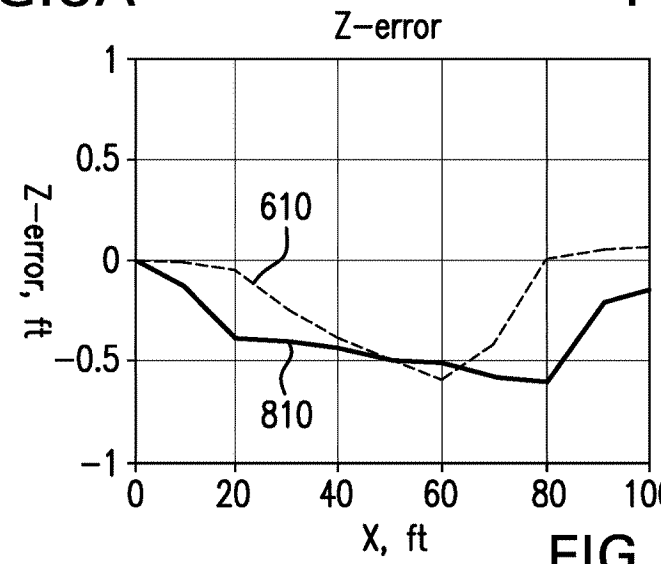
FIG. 8*c* is a plot of Z axis error along the X axis illustrating a difference between actual position along the Z axis and determined position for the drillpath cooperatively defined by FIGS. 6*a* and 8*a* and with the Z axis error of FIG. 6*d* shown as a dashed line for purposes of comparison.

The three-dimensional effect is mainly due to changes in transmitter yaw and to the lateral offset resulting in slightly different fluxes measured by the homing receiver antennas. Minor changes of measured pitch can also contribute to this effect. The lateral offset reaches a maximum of five feet at a point 802 in plot 800. FIG. 8*b* is a plot of the vertical homing command 806 as further influenced by the lateral deviation in FIG. 8*a*. For purposes of comparison, homing command plot 602 of FIG. 6*b* is shown as a dashed line. It is noted that the difference between plots 602 and 806 is not viewed as significant in terms of overall results of the homing procedure. FIG. 8*c* illustrates the Z error 810 along the X axis which includes the effects of yaw and lateral deviation from the X,Z plane with Z error plot 606 of FIG. 6*d* shown as a dashed line for purposes of comparison. Even for a significant 5 foot lateral deviation, as seen in FIG. 8*a*, the accuracy of the vertical homing command is near that of the two-dimensional test case of FIG. 6*a*, as is evidenced by FIG. 8*c*. That is, the maximum Z error is approximately 7 inches in each case but the three-dimensional effect of the lateral transmitter offset, shown in FIG. 8*a*, causes the maximum Z error to move closer to the target. Thus, the present example confirms that homing according to the present disclosure is highly effective with relatively large amounts of yaw and lateral deviation from the X,Z plane. Accordingly, a relatively reduced accuracy of the horizontal component of the homing command at long range is confirmed by this example as acceptable.

Figure 9:
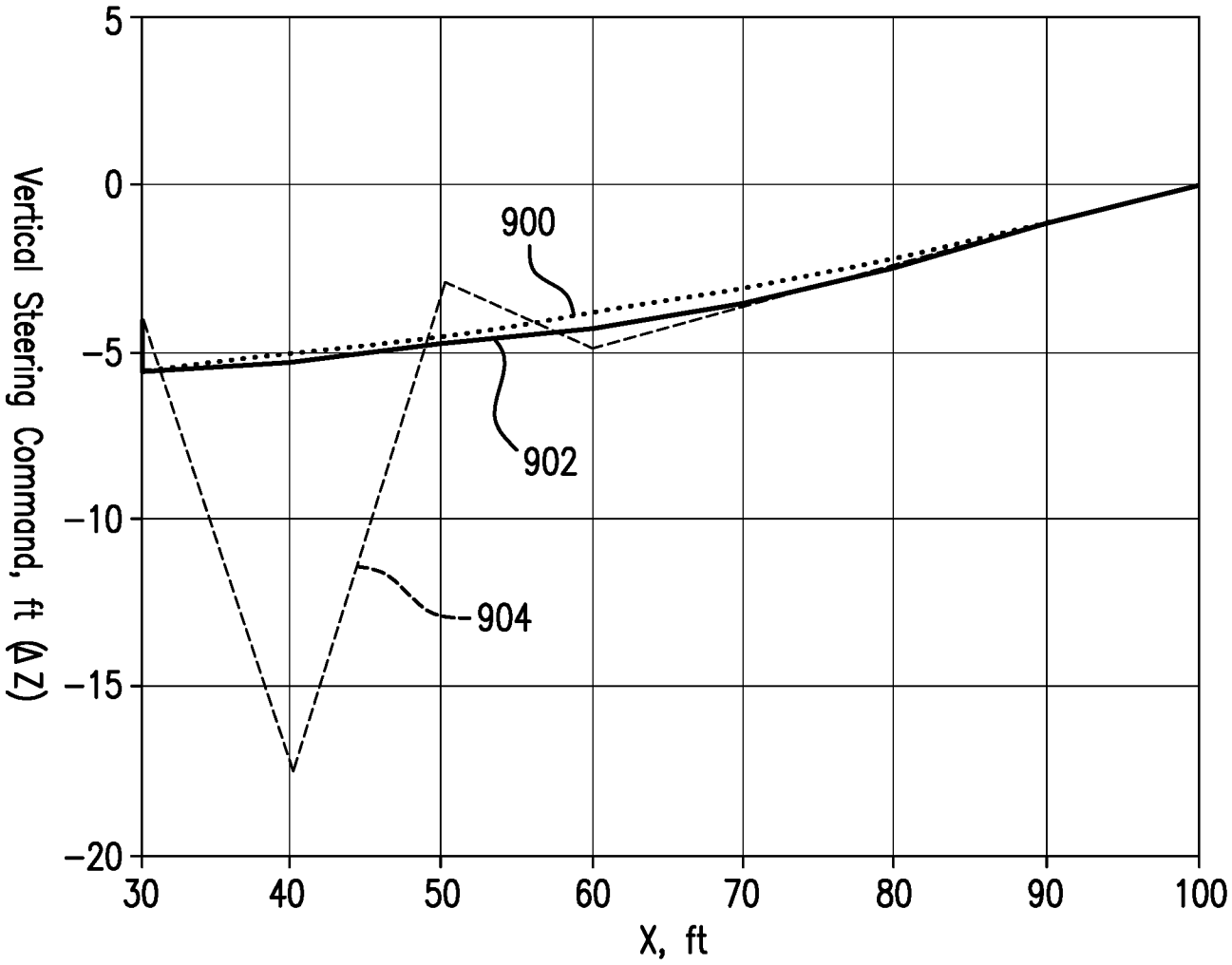
FIG. 9 is a plot of the vertical homing command along the X axis, shown here for purposes of comparing the accuracy of the homing commands of a conventional homing system with the accuracy of vertical homing commands generated according to the present disclosure.

FIG. 9 illustrates the vertical homing command, ΔZ versus X based on the drill path depicted in FIG. 6*a*. A first plot 900, shown as a dotted line, illustrates the vertical homing command for the exact drill path (see also, plot 602 of FIG. 6*b*). A second plot 902, shown as a dashed line, illustrates the vertical homing command derived based on a conventional system which generates the homing command based solely on flux measurements. A third plot 904, shown as a solid line, illustrates the homing command based on the use of the Kalman filter. It should be appreciated that the homing receiver is located at X=100 feet such that positions to the left in the view of the figure are relatively further from the homing receiver. It can be seen that the Kalman filter plot 902 and the conventional plot 904 agree well with the exact homing command plot 900 when the transmitter is within 40 feet or so of the homing receiver. That is, the value of X is greater than 60 feet in the plot. At larger distances from the homing receiver (i.e., below X=60 feet, the conventional system becomes increasingly unreliable and eventually fails to provide any meaningful homing guidance, for example, proximate to X=40 feet. Kalman filter plot 904, however, closely tracks the exact homing command values of plot 900 along the entire drill path, even at greater distances from the homing receiver, including proximate to X=40 feet at which the conventional system is essentially unusable. It should be appreciated that attempting to use the conventional system at long range would result in dramatically oversteering the boring tool upward.

In view of the foregoing, it should be appreciated that a homing apparatus and associated method have been described which can advantageously use a measured parameter in the form of the drill string length in conjunction with measured flux values to generate a vertical homing command. Further, a nonlinear solution procedure can be employed in order to remarkably enhance vertical homing command accuracy and homing range as compared to conventional homing implementations that rely only on flux measurements.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. In a system including a boring tool that is moved by a drill string using a drill rig that selectively extends the drill string to the boring tool to form an underground bore such that the drill string is characterized by a drill string length which is determinable, a homing apparatus comprising:

a transmitter, supported by the boring tool, for transmitting a time varying dipole field as a homing field and including a pitch sensor for detecting a pitch orientation of the boring tool;

a receiver that is positionable at least proximate to a target location for detecting the homing field to produce a set of flux measurements;

a processor that is configured to generate a vertical homing command and a horizontal homing command by combining the detected pitch orientation and the set of flux measurements with a determined length of the drill string and the processor is further configured for generating the vertical homing command at a particular accuracy that is more accurate than another accuracy of the horizontal homing command for use in controlling depth in directing the boring tool to said target location; and a display for displaying the vertical homing command and the horizontal homing command for guiding the boring tool to the target location.

2. The homing apparatus of claim 1 wherein said receiver is configured for receiving the homing field to generate a set of flux measurements as the boring tool is sequentially advanced through a series of positions along the underground bore and, at each one of the positions (i) the pitch orientation is detected by the pitch sensor, (ii) a set of flux measurements is generated based on reception of the homing field by the receiver and (iii) the drill string is of said determined length such that at least the set of flux measurements is subject to a measurement error and said processor is configured for determining the vertical homing command, at least in part, by compensating for said measurement error, which measurement error would otherwise accumulate from each one of the series of positions to a next one of the series of positions, to thereby reduce the particular accuracy of the vertical homing command.

3. The homing apparatus of claim 2 wherein the receiver is configured in a way which produces an inaccuracy in said set of flux measurements as said measurement error which inaccuracy increases as a range increases between the boring tool and the receiver.

4. The homing apparatus of claim 1 wherein said processor is configured to establish an uncorrected position of the boring tool along a nominal drill path in a vertical plane that contains an initial position of the boring tool and an initial position of the receiver and to introduce a correction to that uncorrected position to establish a corrected position as part of generating the vertical homing command.

5. The homing apparatus of claim 4 wherein said processor is configured to solve for the vertical homing command as an initial value problem in a nonlinear solution procedure.

6. The homing apparatus of claim 5 wherein said nonlinear solution procedure is selected as one of a method of nonlinear least squares, a SIMPLEX method and Kalman filtering.

7. The homing apparatus of claim 1 wherein the transmitter supports a transmitter antenna for transmitting the homing field and the transmitter antenna includes a transmitter antenna center and the receiver includes a homing antenna for receiving the homing field, the homing antenna including a homing antenna center and the vertical homing command is expressed for a vertical plane that contains the transmitter antenna center and the homing antenna center such that the vertical plane is initially defined by an initial position of the receiver and an initial position of the boring tool and which further contains a horizontal X axis and a vertical Z axis coordinate system such that the flux measurements of the homing signal include a $b_X$ component and a $b_Z$ component, respectively, as measured at the receiver with an origin of the coordinate system located at a surface of the ground and selected as one of coincident with the transmitter antenna center or vertically above the transmitter antenna center.

8. The homing apparatus of claim 7 wherein said processor is configured to couple the flux measurements taken at a given position of the boring tool to a determined position in the vertical plane that is based at least in part on a pitch orientation that is detected at the boring tool.

9. The homing apparatus of claim 8 wherein said processor is configured to couple the flux measurements to the determined position based on a measurement equation that is expressed as:

$$\vec{B}=3x_{hr}R^{-5}\vec{R}-R^{-3}\vec{u}$$

with $$\vec{B}=(b_X,b_Z)'$$

$$\vec{R}=(X_{hr}-X,Z_{hr}-Z)'$$

$$R=|\vec{R}|$$

$$\vec{u}=(\cos\phi,\sin\phi)'$$

$$x_{hr}=\vec{u}'\vec{R}$$

where $x_{hr}$ is the receiver position as measured along an x axis which is an elongation axis of the homing transmitter antenna extending from the transmitter antenna center, $\vec{B}$ is a total flux vector in the X,Z plane made up of flux components $b_X$ and $b_Z$, $\vec{R}$ is a position vector extending from the transmitter antenna center to the homing antenna center, R is the magnitude of position vector $\vec{R}$, X and Z represent the transmitter position coordinates in the vertical plane, $X_{hr}$ and $Z_{hr}$ represent the position of the receiver in the X,Z plane, $\phi$ is the detected pitch of the boring tool and $\vec{u}$ is a pitch orientation vector.

10. The homing apparatus of claim 9 wherein said processor is configured to solve for the homing commands with homing process equations given as $$\dot{X}=\cos\phi$$

$$\dot{Z}=\sin\phi$$

where $\phi$ is the measured pitch of the boring tool, $\dot{X}$ is a first derivative of X with respect to arc length along an axis of the drill string and $\dot{Z}$ is a first derivative of Z with respect to arc length along the axis of the drill string and a homing measurement equation that is given as $$\vec{B}=3x_{hr}R^{-5}\vec{R}-R^{-3}\vec{u}$$

with $$\vec{B}=(b_X,b_Z)'$$

$$\vec{R}=(X_{hr}-X,Z_{hr}-Z)'$$

$$R=|\vec{R}|$$

$$\vec{u}=(\cos\phi,\sin\phi)'$$

$$x_{hr}=\vec{u}'\vec{R}$$

where $x_{hr}$ is the receiver position as measured along an x axis which is an elongation axis of the homing transmitter antenna extending from the transmitter antenna center, $\vec{B}$ is a total flux vector in the X,Z plane made up of flux components $b_X$ and $b_Z$, $\vec{R}$ is a position vector extending from the transmitter antenna center to the homing antenna center, R is the magnitude of position vector $\vec{R}$, X and Z represent the transmitter position coordinates in the vertical plane, $X_{hr}$ and $Z_{hr}$ represent the position of the receiver in the X,Z plane, $\phi$ is the detected pitch of the boring tool and $\vec{u}$ is a pitch orientation vector.

11. The homing apparatus of claim 1 wherein the receiver includes a set of three orthogonally opposed antennas for determining the set of flux measurements of the homing field to provide three flux measurements taken along three orthogonally opposed directions.

12. The homing apparatus of claim 1 wherein said processor is further configured to generate the determined length of the drill string based on multiplying a total number of drill rods that make up the drill string length by a nominal length of each drill rod.

13. The homing apparatus of claim 1 further comprising a drill string measurement arrangement to measure the drill string length to produce the determined length.

14. The homing apparatus of claim 1 wherein the vertical homing command is directed to controlling depth of the boring tool for approaching the target location during a horizontal directional drilling operation and the horizontal homing command is directed to controlling yaw of the boring tool for approaching the target location during the horizontal directional drilling operation.

* * * * *